US005257702A

United States Patent [19]

Grafstein

[11] Patent Number: 5,257,702

[45] Date of Patent: Nov. 2, 1993

[54] DISPLAY AND DISPENSING DEVICE

[75] Inventor: Norman Grafstein, Huntington, N.Y.

[73] Assignee: North American Enclosures, Inc., Central Islip, N.Y.

[21] Appl. No.: 916,582

[22] Filed: Jul. 22, 1992

[51] Int. Cl.[5] ..... A47F 1/00

[52] U.S. Cl. ..... 211/106; 211/59.2

[58] Field of Search ..... 211/106, 43, 49.1, 59.2; 312/60, 61; 40/124, 124.4; 206/44.11, 44 R, 449

[56] References Cited

U.S. PATENT DOCUMENTS

| | | | |
|---|---|---|---|
| 2,331,361 | 10/1943 | Tuttle et al. | 206/44.11 |
| 3,114,459 | 12/1963 | Kersting | 211/49.1 X |
| 3,595,404 | 7/1971 | Goldstein | 211/106 X |
| 3,780,873 | 12/1973 | Silva | 211/43 X |
| 4,498,592 | 2/1985 | Colucci | 211/106 X |

*Primary Examiner*—Mark Rosenbaum

*Assistant Examiner*—Jeanne M. Elpel

*Attorney, Agent, or Firm*—Howard C. Miskin

[57] ABSTRACT

A display and dispensing device for picture frames includes a wire or rod rack open at its front and top and a rod formed door includes upper and lower lateral bars terminating in integrally formed eyes rotatably engaging a vertical front end rod of the rack. Affixed to the door are a forwardly projecting bottom bracket for supporting a picture frame and an upper loop for engaging the picture frame hinged rear leg. Affixed to the rear of the rack is a separable coupling member including rearwardly projecting laterally spaced arms terminating in upwardly directed fingers permitting the separable mounting of vertically and horizontally spaced devices to a peg board, vertically spaced slotted tracks or other support. The rack may be loaded from the front or top with a horizontal stack of picture frames.

13 Claims, 2 Drawing Sheets

DISPLAY AND DISPENSING DEVICE

BACKGROUND OF THE INVENTION

The, present invention relates generally to improvements in dispensing devices and it relates particularly to an improved device for displaying and storaging articles for retrieval and distribution.

In the merchandising of many articles and products, for example, picture frames which are available not only in different kinds but in various dimensions it is a common practice to display one of different types of the article at a point of sale where the customer selects the type of article as well as the desired size or dimensions. The sales attendant then goes from the point of display and sale to a storage area where he withdraws the desired article from an extensive storage of the articles, carries the article forward where it is individually packaged and dispensed to the buyer. This procedure is highly inefficient, time and space consuming, costly, inconvenient and otherwise leaves much to be desired.

BRIEF DESCRIPTION OF THE INVENTION

It is a principal object of the present invention to provide an improved merchandising and distribution device.

Another object of the present invention is to provide an improved device for displaying an article and for proximately storaging a stack of the articles for the individual dispensing of the stacked articles.

Still another object of the present invention is to provide an improved article display and dispensing device in which the stacked articles are available through the front and top of the device permitting loading of the device and the withdrawal of individual articles from the top and front of the device.

A further object of the present invention is the provision of an improved display and dispensing device which may be separably mounted in vertical columns and vertically spaced rows on a peg board or other support structure.

Still a further object of the present invention is to provide a device of the above nature characterized by its low cost, attractive appearance, ease and convenience of use and great versatility and adaptability.

The above and other objects of the present invention will become apparent from a reading of the following description taken in conjunction with the accompanying drawings which illustrate preferred embodiments thereof.

A display and dispensing device in accordance with the present invention includes a rack member open at its top and front and having a bottom, sides and rear, a door hinged to the front of the rack member and swingable between open and closed positions, respectively closing and opening the front of the rack member, a support means on the front of the door for separably and releasably holding an article for display and a coupling means comprising a coupling member on the rear of the rack for releasably mounting device to a vertical support.

In its preferred form as applied to the display and dispensing of picture frames, the rack member and door member are each formed rod or wire, bent to shape, the door having integrally formed eyes rotatably engaging vertical posts forming part of the rack member. The coupling member includes laterally spaced rearwardly projecting arms terminating in upwardly directed fingers permitting its separable attachment to a peg board, slotted track or the like, and the door article support includes a forwardly projecting bracket on the lower front of the door.

The improved device is convenient to use, of low cost, attractive, rugged and of great versatility and adaptability and may be mounted on a vertical support or a horizontal counter.

DESCRIPTION OF THE PREFERRED EMBODIMENT

Figure 1:
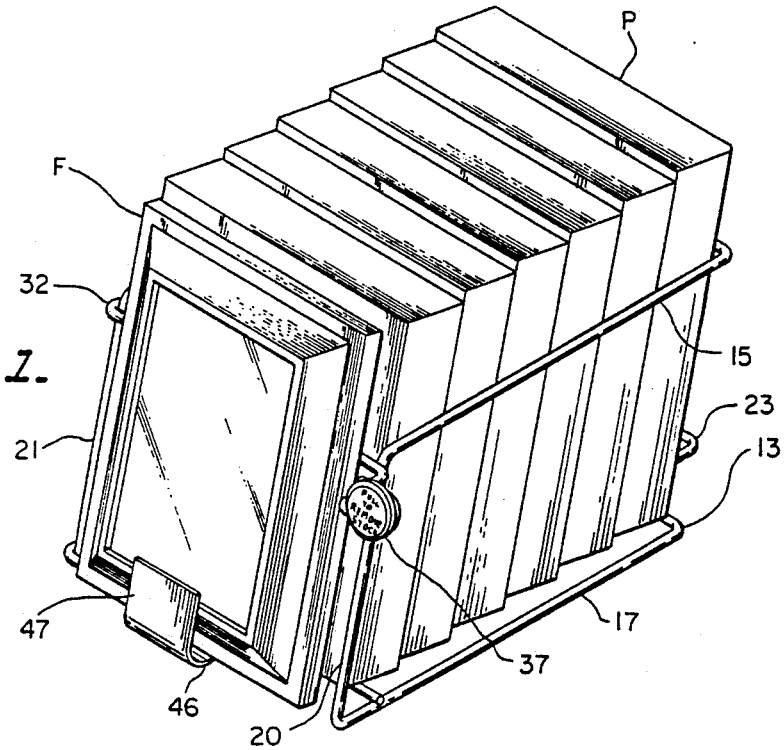
FIG. 1 is a front perspective view of a loaded display and dispensing device embodying the present invention shown in loaded closed condition.

Referring now to the drawings which illustrate a preferred embodiment of the present invention, the reference numeral 10 generally designates the improved display and dispensing device. The device 10 is illustrated, by way of example, as applied to the display of a picture frame F and the storing for dispensing a horizontal stack of packages P of pre-wrapped picture frames similar to picture frame F being displayed. It should be noted, however, that the device 10 may be dimensioned to accommodate picture frames of respectively different dimension or other articles or products.

The device 10 is primarily constructed of bent metal wire or rod and includes a storage rack 11 with an open front and a door 12 hinge connected to the rack for swinging between an open position providing end access to the rack through its front opening and a closed position covering the rack front opening. The door 12 also functions to carry and display an unwrapped picture frame F.

The rack 11 comprises a bent wire integrally formed main body 13 which includes longer upper and shorter lower parallel horizontal U-shaped similar wire sections 14 and 16 respectively, each upper and lower section having laterally spaced longitudinally extending side legs 15 and 17 respectively, the upper section side legs 15 being joined at their rear ends by an integrally formed upper laterally extending cross-arm 18 and the lower section side legs 17 being joined at their rear end by an integrally formed laterally extending cross-arm 19. The front ends of one pair of vertically spaced side legs 15 and 17 are joined by an integrally formed vertical cross-arm 20 and the other pair of vertically spaced side legs 15 and 17 are joined by an integrally formed vertical cross-arm 21.

A rod 22 extends laterally across and rests on lower longitudinal legs 17 shortly rearwardly of the fronts thereof and is secured to legs 17 by welding or other suitable manner. Resting on rod 22 and cross-arm 19 and extending medially between bottom legs 17 is a longitudinal rectangular frame 23 which is secured to rod 22 and arm 19. Frame 23 includes longitudinal legs 24 which extend rearwardly beyond cross-arm 19 and are joined at their ends by a lateral cross-arm 26 shortly rearwardly of cross-arm 18. Legs 24 extend forwardly of rod 22 and terminate in vertical legs 27 connected at their tops by an integrally formed horizontal lateral cross-arm 28 which lies in the plane of vertical arms 20 and 21.

The door 12 is formed of suitably mutually secured and bent rods and includes upper and lower parallel horizontal arms 29 and 30 respectively, each of which is looped at one end to form a hinge eye 32 which rotatably engages vertical arm 21. A pair of transversely spaced parallel vertical arms 33 extend between and are secured to arms 29 and 30. Upper arm 30 at the end remote from eye 32 terminates in a forwardly projecting leg 34 having formed at its front an outwardly laterally projecting loop 36 having a knob 37 secured to the front thereof.

Extending between and secured to the front of vertical legs 33 intermediate the ends thereof is a cross-arm 38 to which is secured between its ends a forwardly projecting horizontal coupling U-shaped hoop 39 which includes a front lateral cross-arm 40 terminating in rearwardly projecting short legs 41 secured to rod 38. A second transverse U-shaped loop 42 is medially located on and projects forwardly from rod 30 and includes a cross arm 43 terminating in rearwardly projecting legs 44 secured to rod 30. A support bracket 46 is located forwardly of and is carried by door 12 and includes a vertical transverse front plate 47 joined by a curved rearwardly downwardly inclined integrally formed panel 48 to cross-arm 43 intermediate the ends thereof.

A pair of medially located laterally spaced parallel downwardly forwardly inclined rods 49 extend between and are secured to cross-arms 18 and 19. Affixed to the upper rear faces of rods 49 is a mounting or coupling member 50 which includes a rectangular plate 51 extending across and welded or otherwise secured to rods 49 and provided along its top edge with integrally formed laterally spaced rearwardly horizontally extending legs 52 terminating in upwardly projecting fingers 53 rounded at their ends and parallel to plate 51. The spacing between fingers 53 is advantageously equal to the spacing between the openings or holes in the conventional peg board.

In order to separably mount one or more dispensing devices 10 on a wall W, one or more vertically spaced laterally extending coupling tracks 56 are affixed to wall W. Each track 56 includes a longitudinally extending cross-web 57 abutting the face of wall W and having forwardly projecting arms 58 along its opposite edges, arms 58 terminating in inwardly directed flanges 59 delineating a longitudinal slot 60. In mounting a device 10 on wall W, the device 10 is forwardly upwardly inclined to bring fingers 53 to a horizontal position whereupon the fingers are inserted through slot 60 and the device 10 lowered to a horizontal position with the cross rod 26 abutting wall W. To detach device 10 the above procedure is reversed.

Figure 5:
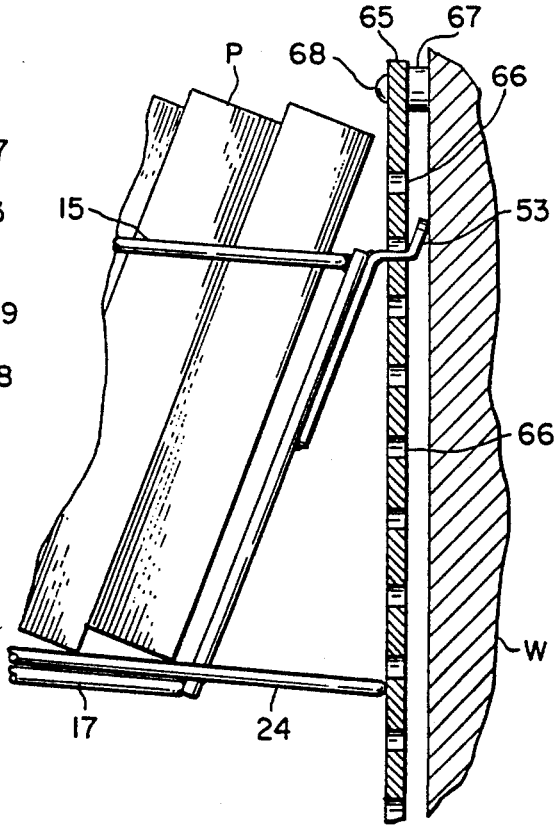
FIG. 5 is a view similar to FIG. 4 but showing the device mounted on a peg board.

In an alternate arrangement, as shown in FIG. 5, a peg board 65 of conventional construction including regularly vertically and horizontally spaced coupling holes 66 is suitably mounted on wall W and positioned forwardly thereof by spaced sleeves 67 engaging the peg board mounting screws 68. A dispensing device 10 is separably coupled to peg board 65 by inserting fingers 53 in correspondingly spaced peg board holes 66 and proceeding in he manner described above.

Figure 2:
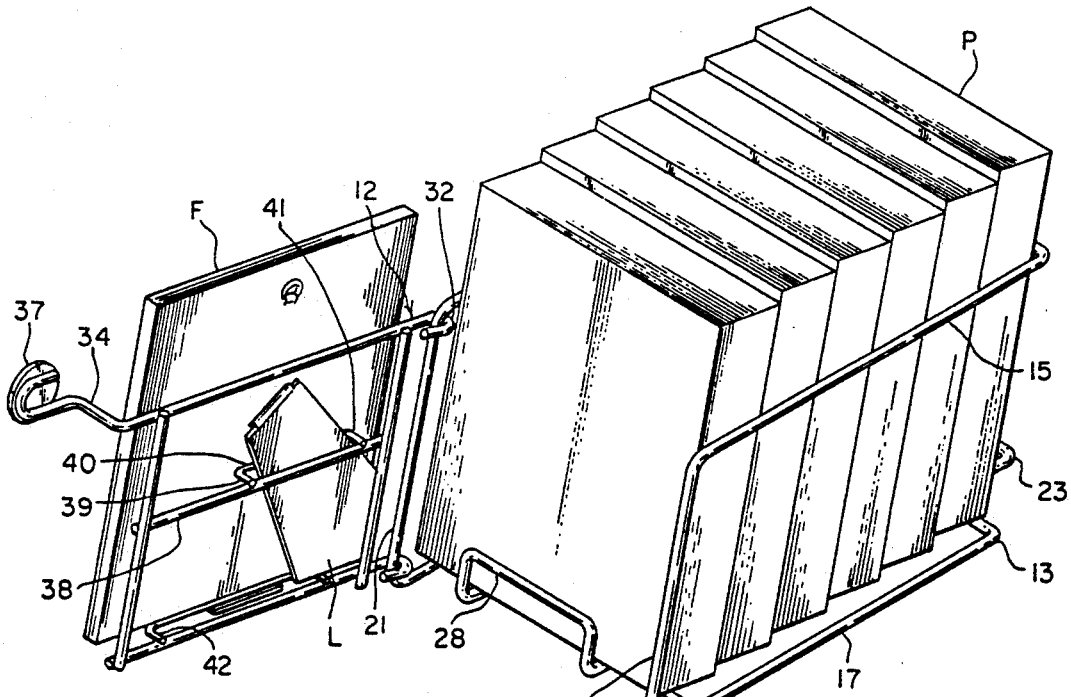
FIG. 2 is a view similar to FIG. 1 but shown in open condition.
Figure 3:
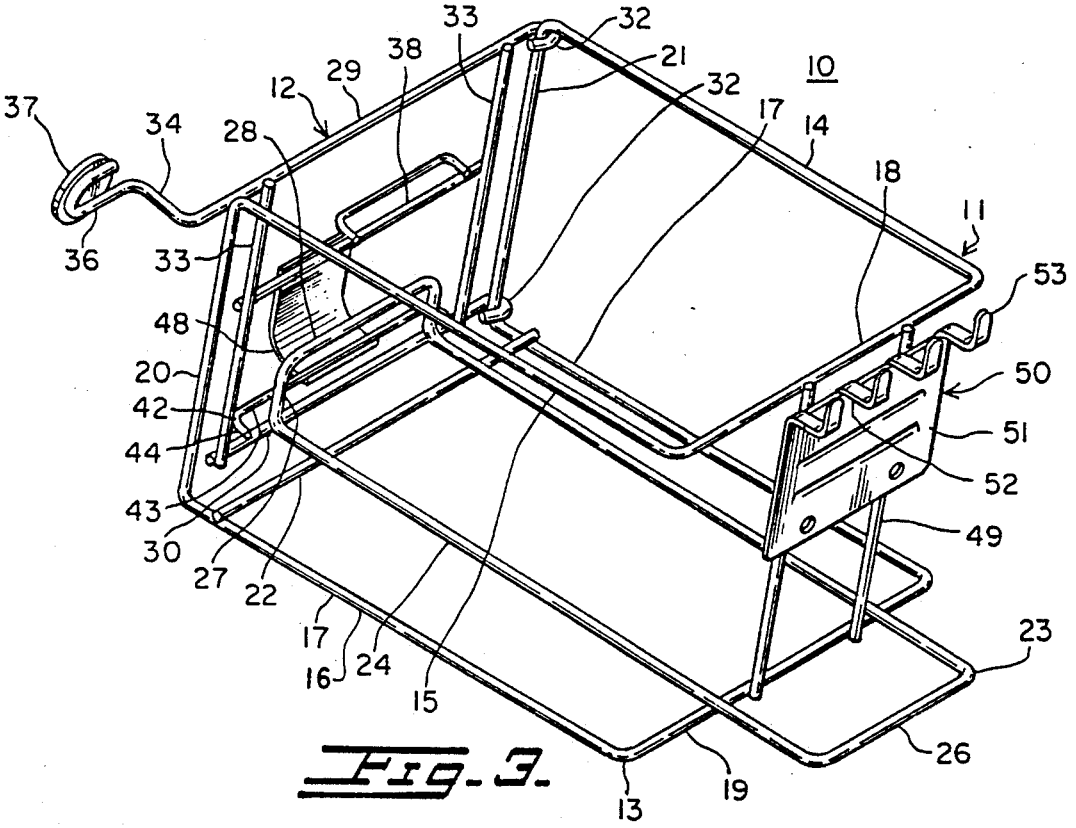
FIG. 3 is a rear perspective view of the device shown in an empty closed condition.
Figure 4:
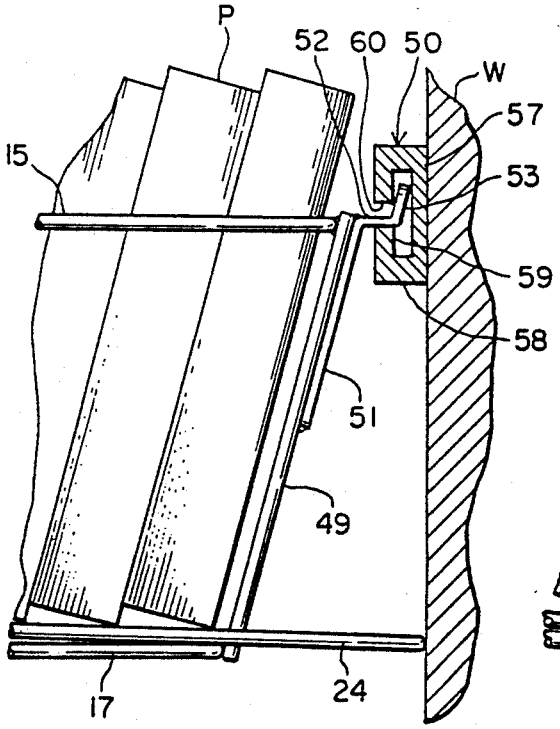
FIG. 4 is a fragmentary side elevational view of the device shown wall supported on a mounting rail.

In employing the device 10, it is loaded with a horizontal stack of rearwardly upwardly inclined pre-packaged picture frames P as shown in FIGS. 1 and 2, either through the open top of storage rack 11 or through the front of storage rack 11 by swinging door 12 to an open position (FIG. 2) providing access through the rack front opening. A picture frame F is mounted on door 12 by positioning the frame F on bracket 46 while inserting the frame hinged support leg L through loop 39. When a plurality of vertically spaced dispensing devices 10 is mounted on wall W and adequate loading access or retrieval of packages P is not available, access for package loading or dispensing is available through the front of rack 11 by opening door 12. It should be noted that a dispensing device 10 may be located on a counter so that top access is available through the front of rack 11 by opening door 12. It should be noted that a dispensing device 10 may be located on a counter so that top access is available to the rack 11 permitting package loading and dispensing through the rack top opening.

While there has been described and illustrated preferred embodiment of the present invention, it is apparent that numerous alterations, omissions and additions may be made without departing from the spirit thereof.

I claim:

1. A display and dispensing device comprising a rack member including a bottom, sides and rear and being open at its front and top, a door hinged to one of said sides of said rack and being swingable between a closed position registering with and an open position providing access through said open front to said rack, means for separably supporting on the front face of said door an article to be displayed and coupling means affixed to the rear of said rack member for supporting said device in a cantilevered forwardly projecting position.

2. The device of claim 1 wherein said coupling means comprises a plurality of laterally spaced rearwardly projecting legs terminating in upwardly projecting fingers.

3. The device of claim 2 comprising a horizontally mounted laterally extending coupling track having vertically spaced upper and lower flanges delineating a slot, said coupling means legs slidably extending through said slot and resting on said lower flange and said finger extending upwardly into engagement with said upper flange.

4. The device of claim 2 including a vertical peg board having vertically and horizontally spaced coupling holes, said coupling means legs projecting through spaced peg board coupling holes.

5. The device of claim 1 wherein said rack member and said door are each formed of metal rod.

6. The device of claim 5 wherein said rack member comprises an integrally formed body member including a pair of vertically spaced upper and lower horizontal, parallel U-shaped sections each having a rear laterally extending cross-arm and longitudinal legs extending forwardly of the ends of respective cross-arms, the forward ends of each vertically spaced pair of legs being joined by an integrally formed front vertical arm.

7. The device of claim 6 wherein said door comprises a pair of laterally spaced vertical door rods and a pair of vertically spaced upper and lower laterally extending parallel door rods affixed to said vertical door rods and terminating at an end of each thereof in an integrally formed eye rotatably engaging one of said body member vertical arms.

8. The device of claim 7 wherein said article support means comprises a bracket including a forwardly projecting arm affixed at its rear to said lower laterally extending door rod and terminating at its front in an upwardly projecting leg.

9. The device of claim 8 including a pair of upper and lower laterally extending loop members affixed to an projecting forwardly from said respective upper and lower laterally extending door rods.

10. The device of claim 7 wherein one of said laterally extending door rods terminates at an end thereof remote from the end having said eye in a forwardly projecting knob member.

11. The device of claim 6 wherein said body member upper section cross arm is positioned rearwardly of said body member lower section cross arm and including a medially spaced pair of laterally spaced forwardly downwardly inclined rear rods affixed to said body member cross arms.

12. The device of claim 11 wherein said coupling means comprises a plate extending between and affixed to said rear rods and terminating along its top in laterally spaced rearwardly extending arms terminating in upwardly projecting fingers.

13. The device of claim 11 including a laterally extending bottom cross rod resting on and affixed to said body member lower section longitudinally extending arms and a rectangular frame including laterally spaced longitudinally extending arms resting on and affixed to said bottom cross arm and said body member bottom section cross arm and terminating at its rear in a cross arm positioned rearwardly of said bottom section cross arm and at its front in a raised cross arm.

* * * * *